United States Patent [19]

Muhe et al.

[11] 3,986,311

[45] Oct. 19, 1976

[54] REINFORCEMENT FOR PRESTRESSED CONCRETE MEMBERS OR BUILDINGS

[75] Inventors: Ludwig Muhe, Oberursel; Wolfram Illgner, Friedberg; Andreas Krieg, Bad Ems, all of Germany

[73] Assignee: Philipp Holzmann Aktiengesellschaft, Frankfurt am Main, Germany

[22] Filed: June 19, 1975

[21] Appl. No.: 588,461

[30] Foreign Application Priority Data

June 24, 1974 Germany ..... 2430170

[52] U.S. Cl. ..... 52/223 R; 52/733; 52/726

[51] Int. Cl.[2] ..... E04C 3/10

[58] Field of Search ..... 52/733, 737, 738, 739, 52/740, 735, 677, 687, 223

[56] References Cited

UNITED STATES PATENTS

| | | | |
|---|---|---|---|
| 505,664 | 9/1893 | Lee | 52/737 |
| 843,843 | 2/1907 | Reavis | 52/739 |
| 2,938,355 | 5/1960 | Dougherty | 52/726 |
| 3,115,727 | 12/1963 | Middendorf | 52/733 |
| 3,347,005 | 10/1967 | Preston, Jr. | 52/733 |

FOREIGN PATENTS OR APPLICATIONS

| | | | |
|---|---|---|---|
| 568,009 | 1958 | Canada | 52/737 |
| 1,095,423 | 1967 | United Kingdom | 52/733 |

*Primary Examiner*—Price C. Faw, Jr.
*Assistant Examiner*—Robert C. Farber
*Attorney, Agent, or Firm*—Haseltine, Lake & Waters

[57] ABSTRACT

A reinforcement arrangement of high-tension resistant steel for prestressed concrete members or buildings, in which rigidly attached projecting portions protrude substantially from the periphery of the reinforcement. Passages between the projecting portions and the periphery of the reinforcement permit embedding of the reinforcement in the form of a bundle or packet consisting of one or several reinforcements, in a predetermined material which is subsequently introduced. Such material may be in the form of a corrosion inhibitor, or compact substance such as cement mortar. The reinforcement may be in the form of a multistrand wire or cable in which the projecting portions are annular and located at predetermined intervals along the length of the reinforcement. The projecting portions may be of iron or steel, as well as plastic material.

20 Claims, 11 Drawing Figures

REINFORCEMENT FOR PRESTRESSED CONCRETE MEMBERS OR BUILDINGS

BACKGROUND OF THE INVENTION

The present invention relates to the reinforcement of high-tension-resistant steel for prestressed concrete members or buildings.

In the production of prestressed concrete and also with prestressed concrete buildings or members, as, for example, in prestressed concrete pressure containers, the reinforcemens are wound under tension onto the outside of the container wall and later, to prevent corrosion, are enveloped with a corrosion inhibitor or compact material, e.g., cement mortar.

The adherence of the reinforcements is of considerable importance. This applies especially to reinforcements which are embedded without end anchoring in the cement mortar. It is also applicable to reinforcements which are located through intermediate anchoring, e.g., on a container wall or at the rear wall by winding channels placed in a container wall. These horizontal windings channels of rectangular cross section are at first open toward the outside, but later are pressed out, e.g., after a one-time or repeated retensioning (restressing) of the reinforcements with the corrosion inhibitor or compact material. Such reinforcements, depending on the internal pressure prevailing in the pressure container or depending on the circumferential stress occurring in the container wall, the counteracting circumferential stresses to be generated by the reinforcements in the container wall, are wound in several layers running radically on top of one another and in helical windings adjacent to one another.

The tight enveloping of each reinforcement winding and layer by the corrosion inhibitor or compact material is of great significance. This applies especially when using a compact material e.g., cement mortar, or a tightly closed compact cross section is to be formed. It is also important in view of possible reinforcement breakage and its consequences. The more perfectly the reinforcement windings and layers are embedded in the cement mortar, the smaller is the likelihood that during a reinforcement break an entire reinforcement layer, if only between two intermediate anchorings, unravels. For such perfect embedding of the reinforcements it is necessary that the reinforcements, both within each layer between their windings, and also from layer to layer are sufficiently spaced apart so that the cement mortar to be introduced later, can seep through to all interstices. However, such spacings within a reinforcement bundle or within a reinforcement layer must also be present if the reinforcements and/or their windings are to be enveloped by a protective material, e.g., rust-proofing grease, instead of by a compact material. Otherwise, during the subsequent introduction of such material, there is no guaranty of a perfect rust-proof envelopment of the reinforcements by the material.

It is already known in the art how to increase the adherence of the reinforcements by their profiling. It is also already known to have reinforcements of round or oval cross section made from rod-or ribbon-like reinforcement steel in the manner of twisted concrete cross section steel. Known, furthermore, is the so-called rack tool steel which is provided with a large number of small small beads to increase the adherencce effect. It is, moreover, known to use instead of homogeneous round or oval steels for the formation of multilayer outside windings on container walls or in winding channels of the kind stated above, stranded cables of high-tension-resistant steel wires which can be produced with a relatively large cross section and can be bent with a small radius of curvature. For example, seven-strand cables with an outside diameter of 10 to 15 mm and cross sections of about 140mm$^2$ or larger, are particularly well-suited for reinforcement windings of the type described. They have good relaxation and stress-removal properties for manufacture. Also, such stranded cables, in contrast with homogenous round or oval steel of similar cross-section sizes, can be manufactured in very long lengths, so that much fewer reinforcement joints than with homogeneous steel are required. However, in the case of reinforcements with a large number of stranded cables or stranded cable windings, the grooves between the tightly packed strands or their windings do not provide sufficient space to make possible complete penetration of a reinforcement bundle or packet and a perfect enveloping of the individual reinforcements and/or their windings. Even with the known ribbed or beaded rack tool steel and stranded cables, where the outside wires are profilated, i.e. provided with ribs, this possibility does not exist. These ribs are to provide better adherence to the concrete and a more simple anchoring. Since for stranded cables, without exception, colddrawn wires of high strength are used, only very low ribs can be produced if the strength of the steel is not diminished. The rib heights are around 0.15 mm.

Therefore, it has been proposed that spacers be inserted into a winding or tensioning channel. These spacers separate both individual stranded cables or reinforcements of rod- or ribbon-like reinforcement steel, and individual windings and/or layers of such reinforcements. During the subsequent pressing out of the winding or reinforcement channel, these spacers make possible the free flow of the protective material e.g., of cement mortar. However, the installation of such spacers requires extra effort and restricts the use of machines for bundling the reinforcements.

It is, therefore, an object of the invention to provide a reinforcement comprising either a homogeneous reinforcement steel or a multistranded cable in such a way that both its adherence to a protective or compact material is improved, and assurance is provided that during winding around a concrete member or building, e.g., a container wall, there is formed inside or outside the winding channel a mutual space between the reinforcement windings and the reinforcement layers; this space must be large enough to assure complete envelopment of the reinforcement by the protective or compact material.

Another object of the present invention is to provide a reinforcement of the foregoing character which is simple in design and may be economically fabricated.

A further object of the present invention is to provide a reinforcement arrangement as described, which has a long service life.

SUMMARY OF THE INVENTION

The objects of the present invention are achieved by providing that the reinforcement comprises rigidly attached risers protruding greatly from its circumference. Passthrough locations and paths between these risers and the reinforcement periphery permit complete embedding of the reinforcement bundle or packet, consisting of one or several reinforcements, in a subsequently introduced corrosion inhibitor or compact material, e.g., cement mortar.

The spacing risers may be shaped and arranged in various ways. With a first embodiment of the present invention, which can be used both with rod- or ribbon-like reinforcement steels and with stranded-cable reinforcements, the risers may be annular risers spaced apart in the lengthwise direction of the reinforcement. Such annular risers may be made of steel or synthetic material and may be crimped on and/or bonded to the stranded cable in the factory. Preferably, the annular risers are sleeve-shaped and provided along their outer periphery with annular profilations which may be formed by helical wave indentions.

In accordance with the present invention, the spacing risers in the case of a reinforcement made of rod- or ribbon-like reinforcement steel may be rolled on in the form of longitudinal ribs in the factory.

However, when the reinforcement comprises a multistranded cable, the spacing risers may also be formed by an outermost cable strand which has a larger diameter than the other cable strands, and which constitutes a spacer wire. The outer part of the latter's cross section noticeably protrudes beyond the periphery of the cable. With this embodiment, the reinforcement, comprises a separate stranded cable where the spacer wires constitute a force-absorbing part of the cable itself.

The spacing risers may also be formed, instead of by cable strands, by at least one extra spacer wire which runs in a groove between two outer cable strands helically around the cable in accordance with the stranding.

Finally, the spacing risers may be formed by winding round or profilated wire around the reinforcement. The windings of this wire are spaced apart.

In comparison with conventional reinforcement stranded cables, a reinforcement in accordance with the present invention, because of the spacing risers, has a vastly increased adherence and the additional advantage that the risers form spacers. With reinforcement windings of the type stated or when arranging reinforcements in the form of reinforcement bundles or packets, these spacers make sure that adjacent reinforcements or reinforcement windings of each reinforcement layer and also successive reinforcement windings themselves are wound with a mutual spacing such that a corrosion inhibitor material or a compact material, e.g., cement mortar can be forced into the entire reinforcement packet and each reinforcement winding and each reinforcement layer can be fully enveloped by the material. This makes possible not only perfect corrosion protection of the reinforcements, but, when using a compact material, every reinforcement and especially the outer layer of a multilayer reinforcement winding or of a reinforcement bundle or packet is solidly embedded. Hazardous consequences of a possible reinforcement break are reduced to a large degree. The winding of the reinforcements is not impeded in any manner; with reinforcement windings placed, e.g., around the side walls of a pressure container, the winding can be accomplished easily with a winding machine in accordance with the German Pat. No. P 21 29 978.5. If the reinforcement comprises a stranded cable provided with spacing risers, since as a rule stranded cables can be manufactured in very long lengths and the risers of the present invention can be attached to very long stranded cables, the winding is even made easier because much fewer reinforcement joints are required than with rodlike reinforcements. Bulgingout of the winding by possibly wound joints do not impair the functioning of the winding.

With reinforcement windings which, as already mentioned, e.g., with pressure container with horizontal winding channels running along its periphery and open toward the outside are located in winding channels of rectangular cross section, by later forced embedding of the winding channel in a compact material, e.g., cement mortar, a perfect subsequent adherence can be brought about. As experiments have shown, this adherence fully complies with the directives (regulations) governing subsequent adherence. Preferably, the winding channels are made with disposable casing of corrugated sheet iron; the wave depth should correspond to the proven steel jacket encasing tubes with corrugated walls. Corrugation of the boundary surfaces of the winding channels facilitates lateral flow-around the reinforcement winding when later embedding the winding channels in the compact material. The reinforcements provided with spacing risers can, with any embodiment of the risers, be anchored in the winding channels by means of conventional end anchoring. If necessary, they can be wound around the vertical guide strips located in the winding channels so that, in plan form, with a winding channel of circular vertical rear wall, the winding becomes like a polygon. To inject the winding channels with the compact material, e.g., cement mortar, the winding channels are closed at their open end with removable steel covers or by accessory concrete anchored toward the rear in the winding channels, and then the compact material is injected from the bottom toward the top and flowing laterally. This makes sure that the mortar can penetrate through the pass-through spaces formed between the spacing risers and the periphery of each reinforcement for any embodiment of the risers to all reinforcements or reinforcement layers and reinforcement windings and can fill all interstices.

If the reinforcement consists of a stranded cable and the spacing risers are formed by one or more outer cable strands of larger diameter than the other cable strands, or by one or more additional wires which run in a groove between two cable strands helically around the cable, the spacer wires thus formed can be made of the same high-grade material and therefore participate in the prestressing effect. The cross section of the space wires may be either round or profiled. The spacer wires loosen a bundle of tightly packed cables by forming in them flow-through locations in the form of helical channels which combine with the grooves between the cable stands and thus create sufficient possibilities for the mortar to flow through. When using prestressed-concrete stranded cables with spacer wires in reinforcements with subsequent adherence, the smooth continuous spacer wire does not cause any higher friction losses. If alternately right- and left-handed stranded cables are used in one reinforcement, the spacer wires cross one another and touch only at the points of intersection. This enlarges the flow-through cross section for the mortar. With circumferential prestressing of prestressed concrete pressure containers, the intersections of the spacer wires can be designed in such a way, that the various winding layers are alternately wound with right- and left-handed stranded cables.

The novel features are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
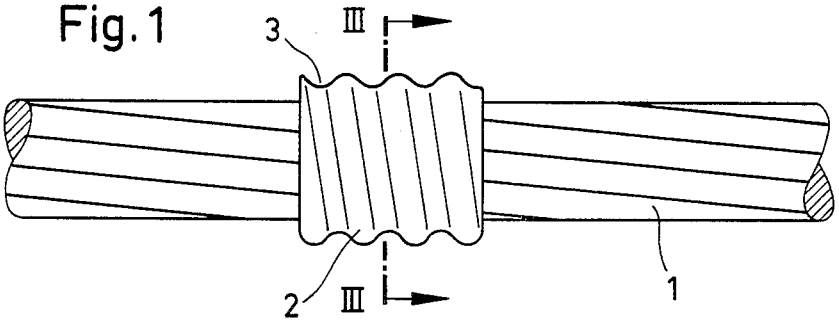
FIG. 1 is a side view of a partial length of a reinforcement consisting of a stranded cable.
Figure 2:
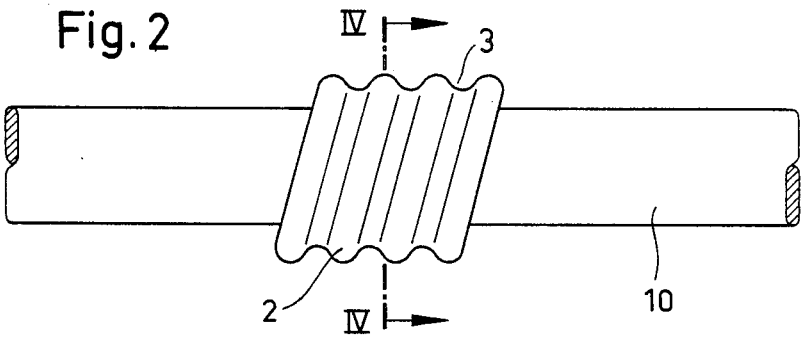
FIG. 2 is a side view corresponding to FIG. 1 of a reinforcement consisting of homogeneous prestressed steel.
Figure 3:
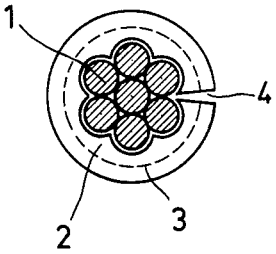
FIG. 3 shows a cross section taken along line III—III of FIG. 1.
Figure 5:
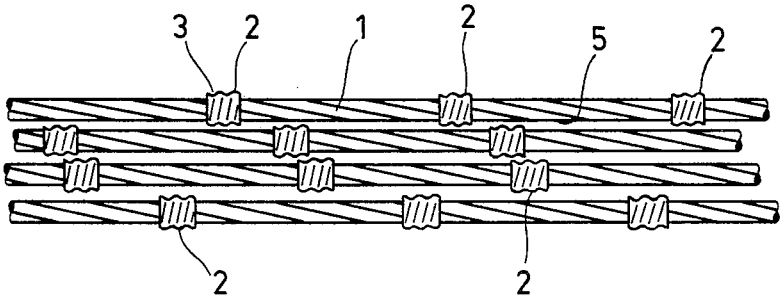
FIG. 5 is the side view of a reinforcement bundle consisting of reinforcements in accordance with the present invention.

Referring to the drawing the reinforcement shown in FIGS. 1 and 3 comprises a seven-wire stranded cable 1 which may have, for example, an outside diameter of about 10 to 15 mm and a cross sectional area of about 140 mm$^2$. At intervals of 6 to 100 cm, the stranded cable has annular risers 2 (attached in the factory) which, in the embodiment shown, are in the form of sleeves. The intervals between the annular or sleeve-shaped risers 2 may be, as shown in FIG. 5, identical and equal with the individual stranded cables. However, this is not necessary. Along their outer periphery, the sleevelike risers 2 have annular profiles formed, as shown, by helical grooves.

The sleevelike risers 2 may be made of steel and be pressed onto stranded cable 1 by the exertion of radial pressure forces and as a result may be rigidly connected to the stranded cable. For easy fastening to stranded cable 1, the sleevelike risers 2 may be provided with a radial groove 4 as shown in FIG. 3. The risers 2 may also be connected rigidly by bonding to each stranded cable. In any case, the annular or sleevelike risers 2 constitute spacers through which all reinforcements or reinforcement turns contained in one reinforcement winding or in one reinforcement bundle, as shown in FIG. 5, are wound or arranged maintaining mutual distances 5. These correspond to the amount of radial protrusion of risers 2 over (beyond) the periphery of the stranded cable 1. In this manner there are formed between the annular risers 2 of stranded cables 1 and the circumference of the stranded cables, numerous pass-through locations or paths which are supplemented at the outside surface of the sleevelike risers by the paths formed by the wave valleys of profile 3 of the risers. For later embedding of the reinforcements and reinforcement windings in a corrosion inhibitor or a compact material, e.g., cement mortar, this material upon pressing into a winding channel, for example, can get between all reinforcements and reinforcement windings located in the winding channel and may fill all spaces of the winding channel compactly and completely, thus perfectly enveloping the reinforcements.

Figure 4:
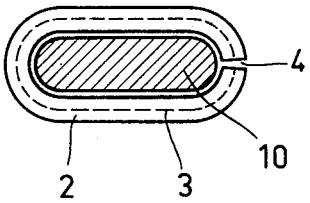
FIG. 4 shows a cross section taken along line IV—IV of FIG. 2.

In the embodiments of FIGS. 3 and 4, the reinforcement 10 consists of homogeneous ribbon-like reinforcement steel on which sleevelike annular risers 2 are attached in the factory, similar to the embodiments of FIGS. 1 and 3. Again, the spacing sleevelike risers are provided on their outside with a wavy profile 3 and a radial groove 4.

With both embodiments, the sleevelike risers 2 may be made of synthetic material and may be bonded in the factory to the periphery of reinforcement 1 or 10, respectively.

Figure 6:
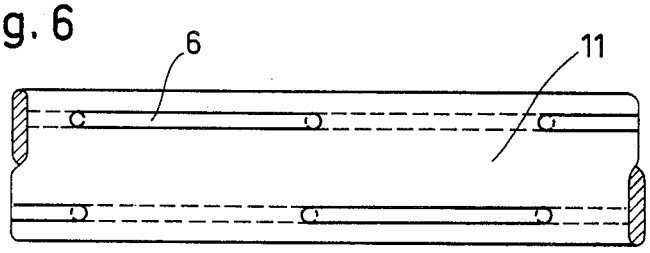
FIG. 6 is the side view of a partial length of another embodiment of a reinforcement made of homogeneous prestressed steel.
Figure 7:
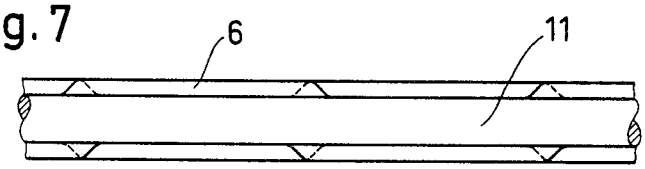
FIG. 7 is the top view for FIG. 6.
Figure 8:
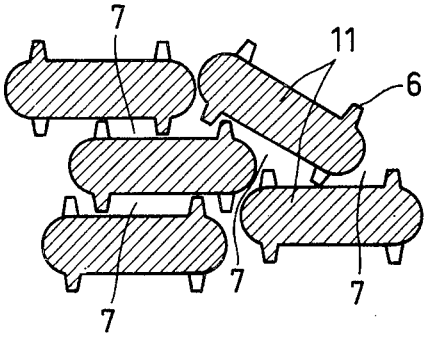
FIG. 8 shows a partial cross section through a reinforcement bundle comprising reinforcements in accordance with FIG. 6 and 7.

FIGS. 6 through 8 show an embodiment where the reinforcement 11 consists of profiled ribbon-like reinforcement steel and where the spacing risers 6 are formed by the profile produced when rolling the reinforcement steel. In the embodiment example shown, the risers 6 have the shape of longitudinal ribs spaced apart in the lengthwise and transverse direction. On each wide side of the reinforcement, there are two rows of risers 6 which are staggered relative to one another. For example, reinforcement 11 may have a cross section area of 200 mm$^2$ where the longitudinal ribs 6 may protrude up to a rib height of, for example, about 2 mm beyond the periphery of the ribbon-like reinforcement steel. In this example, the arrangement of the longitudinal ribs is chosen so that the ribs cross section can be considered in its entirety as part of the reinforcement steel cross section taking the load.

FIG. 8 shows the way several reinforcements 11 or reinforcement windings of the shown embodiment may be arranged in one reinforcement bundle or in one reinforcement winding. In this manner there are formed pass-through locations or paths 7 for a corrosion inhibitor or a compact material, e.g., cement mortar, to be subsequently introduced into the reinforcement bundle or into the reinforcement winding. These locations or paths 7 facilitate complete embedding of the reinforcements or reinforcement windings and a complete filling of all interstices. This complete filling up or enveloping of the reinforcements or reinforcement windings is supported by the fact that in the manufacture of the reinforcement 11 or the ribbon - like reinforcement steel through hot - rolling the width of the reinforcement fluctuates somewhat due to the different roller pressure caused by the profiling or the formation of the longitudinal ribs; as a result, a spacing effect also comes about at the narrow sides of the ribbon-like reinforcement steel.

Figure 9:
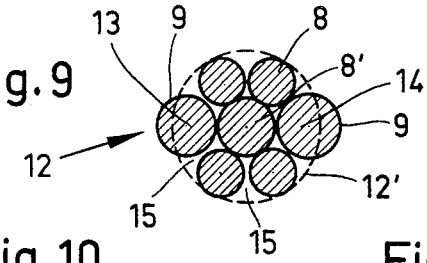
FIG. 9 and 10 show cross sections through other embodiments of a reinforcement comprising a stranded cable.

With the embodiment shown in FIG. 9, the reinforcement 12 again consists of a multistranded wire or a multistranded cable. However, in this embodiment the spacing risers 9 are formed by that part of the cross sections of two outer cable strands 13 and 14 protruding beyond the dashed-line peripheral circle which are stranded with the other strands 8 and 8' to form the seven-strand cable shown. The two outer wires 13 and 14 have a noticeably larger diameter than the other outer wires 8 of the stranded cable and, as components of the stranded cable, constitute spacer wires extending throughout its length. In the embodiment shown, also the center strand, or core strand 8′ has such a larger diameter. However, this core strand might also have the same diameter as wires 8. It is only necessary that the spacer wires 13 and 14 have such a large cross section so that the outer part of their cross section protrudes sufficiently beyond the peripheral circle 12′ of the stranded cable to form the spacing risers 9. These then protrude as helical ribs beyond the periphery of the stranded cable.

With the reinforcement in accordance with FIG. 9, instead of the two spacing wires 13 and 14, only one such wire may be included. Also, the spacer wire (s), instead of a round cross section, may have an oval or other cross section. Thus, they may be square wires rounded off at the corners, for example. In any case, due to the arranging of one or several spacer wires in each reinforcement 12 with a multiplicity of reinforcements running closely next to one another or on top of one another in a reinforcement bundle or packet, there develop between them or their windings flow-through locations in the form of helical channels which, together with the grooves 15 between the strands, permit sufficient room for the flow-through of a corrosion inhibitor or compact material, e.g., injected mortar.

Figure 10:
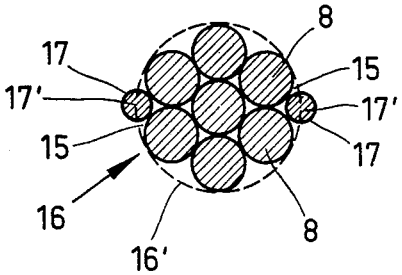

According to FIG. 10, instead of one or more strands of enlarged cross section, there may be attached to a stranded-wire type reinforcement (denoted here by 16 and consisting of wires of identical cross section in the conventional manner) additional spacer wires 17′ to form the spacing risers 17. They may have a smaller diameter than the other strand wires 8 and run in a groove 15 between two outer cable strands 8 so that each additional spacer wire 17′ protrudes as helical rib beyond the circumference of stranded cable 16, indicated in FIG. 10 by dashed line 16′. The spacing effect of the additional spacer wires 17 otherwise is similar to that of the oversize spacer wires 13 and 14 of FIG. 9. Also, the additional spacer wires 17 of FIG. 10 may have any profile desired. In particular, the cross section of wires 17 may be adapted to the shape of the groove 15 existing between the outer cable strands 8. As a result, the spacer wires 17 get a better hold of the stranded cable.

Figure 11:
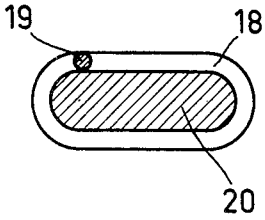
FIG. 11 shows a further embodiment of a reinforcement consisting of ribbonlike reinforcement steel.

With a stranded-cable type reinforcement and with a reinforcement made of rod- or ribbon-like reinforcement steel, e.g., with a ribbon steel reinforcement 20 in accordance with FIG. 11, the spacing risers 18 may also be formed by an additional spacer wire 19 which is wound around the reinforcement in such a way that its windings are spaced apart. Again, the spacer wire 19 may have a round cross section or any other profile, and may have been fastened to reinforcement 20 in the factory by mere winding around or by welding or in any other manner.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A reinforcement of high-tension resistant steel for prestressed concrete members or buildings comprising rigidly attached projecting portions protruding substantially from the periphery of said reinforcement; said projecting portions being distributed over the length of said reinforcement; said projecting portions being spaced apart lengthwise on said reinforcement and holding adjacent portions apart; passage means between said projecting portions and the periphery of adjacent portions, said passage means permitting embedding of said reinforcement in a predetermined material.

2. The reinforcement as defined in claim 1 and comprising further multistrand cable means, said projecting portions having an annular shape and being located at predetermined intervals along the longitudinal direction of said reinforcement.

3. The reinforcement as defined in claim 2 wherein said annular projecting portions are of ferrous material.

4. The reinforcement as defined in claim 2 wherein said annular projecting portions are of plastic material.

5. The reinforcement as defined in claim 2 wherein said annular projecting portions have a sleeve-like shape and have profile means at their outer periphery.

6. The reinforcement as defined in claim 5 wherein said profile means comprise helical wave indentations.

7. The reinforcement as defined in claim 2 wherein said annular projecting portions are spaced apart by an amount of 6 to 100 centimeters.

8. The reinforcement as defined in claim 2 wherein said annular projecting portions have a radial groove for attachment to the reinforcement.

9. The reinforcement as defined in claim 2 wherein said annular projecting portions are crimped onto said reinforcement.

10. The reinforcement as defined in claim 2 wherein said annular projecting portions are bonded to the reinforcement.

11. The reinforcement as defined in claim 1 and comprising further rod-shaped reinforcement steel, said projecting portions being rolled onto said rod-shaped reinforcement steel.

12. The reinforcement as defined in claim 11 wherein said projecting portions are rolled on said rod-shaped reinforcement steel in the form of longitudinal ribs spaced apart along the longitudinal direction of said reinforcement and transversely thereof.

13. The reinforcement as defined in claim 12 wherein said longitudinal ribs are arranged in rows spaced apart transversely and staggered in adjacent rows.

14. The reinforcement as defined in claim 1 and comprising further multistrand cable means, said projecting portions comprising at least one outer cable strand substantially larger in diameter than the remaining cable strands, said outer cable strand comprising a wire spacer.

15. The reinforcement as defined in claim 14 wherein said wire spacer as a substantially round cross-section.

16. The reinforcement as defined in claim 1 and comprising further multistrand cable means, said projecting portions comprising at least one additional wire in a groove between two outer cable strands and arranged helically along the stranded cable, said additional wire comprising a wire spacer.

17. The reinforcement as defined in claim 16 wherein said wire spacer has a predetermined cross-section.

18. The reinforcement as defined in claim 1 wherein said projecting portions comprise wound wire having turns spaced apart from each other.

19. A reinforcement as defined in claim 1 and comprising at least one reinforcement member wound in layers, a plurality of helical windings, a prestressed concrete pressure container having a horizontal winding channel in the container wall, said plurality of helical windings being wound around the wall of said prestressed concrete pressure container and in said horizontal winding channel, said winding channel having a rectangular cross-section and being open towards the exterior, a combination with force-locking connection of all reinforcements and reinforcement windings to one another and to the prestressed concrete pressure container being formed by filling all interstices between the reinforcements and the respective windings and all interstices between the reinforcement winding and the boundary surfaces of the winding channel with a substantially slow-setting hardening substance.

20. The reinforcement as defined in claim 19 wherein the boundary surfaces of said winding channel have wave-shaped profiles, and comprising further pass-through formed for filling the winding channel with said slow-setting substance for flowing around the entire reinforcement winding.

* * * * *